US009151049B2

(12) United States Patent
Rasmussen

(10) Patent No.: US 9,151,049 B2
(45) Date of Patent: Oct. 6, 2015

(54) ROOF WINDOW WITH AN INSULATING ELEMENT

(71) Applicant: VKR HOLDING A/S, Hørsholm (DK)

(72) Inventor: Sten Rasmussen, Børkop (DK)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/349,593

(22) PCT Filed: Oct. 4, 2012

(86) PCT No.: PCT/DK2012/050372

§ 371 (c)(1),
(2) Date: Apr. 3, 2014

(87) PCT Pub. No.: WO2013/050040

PCT Pub. Date: Apr. 11, 2013

(65) Prior Publication Data

US 2014/0230349 A1 Aug. 21, 2014

(30) Foreign Application Priority Data

Oct. 4, 2011 (DK) ..... 2011 70549

(51) Int. Cl.

| | |
|---|---|
| ***E04B 1/346*** | (2006.01) |
| ***E04B 7/18*** | (2006.01) |
| ***E04D 13/03*** | (2006.01) |
| ***E04D 13/035*** | (2006.01) |
| ***E06B 7/23*** | (2006.01) |

(52) U.S. Cl.

CPC ..... *E04B 7/18* (2013.01); *E04D 13/031* (2013.01); *E04D 13/0354* (2013.01); *E06B 7/2314* (2013.01)

(58) Field of Classification Search

CPC ..... E04D 13/0305; E04D 13/031; E04D 13/0315; E04D 13/0357; E04D 13/0354; E04B 7/18; E04B 7/2314

USPC ..... 52/72, 200

See application file for complete search history.

(56) References Cited

U.S. PATENT DOCUMENTS

| | | | | | |
|---|---|---|---|---|---|
| 4,549,379 | A | * | 10/1985 | Hoy et al. | 52/200 |
| 4,570,393 | A | * | 2/1986 | Minter | 52/72 |
| RE32,539 | E | * | 11/1987 | Jentoft et al. | 52/200 |
| 4,776,141 | A | * | 10/1988 | Powell | 52/200 |
| 4,928,445 | A | * | 5/1990 | Sampson et al. | 52/72 |
| 4,930,275 | A | * | 6/1990 | Verby et al. | 52/200 |
| 4,987,705 | A | * | 1/1991 | Sampson et al. | 52/72 |

(Continued)

FOREIGN PATENT DOCUMENTS

DE 202004021033 10/2006

*Primary Examiner* — Brian Glessner
*Assistant Examiner* — Joshua Ihezie
(74) *Attorney, Agent, or Firm* — Timothy D. St. Clair; Nexsen Pruet, LLC

(57) ABSTRACT

A roof window (1) comprising a frame (2) with a top member (5), a bottom member (6) and two side members (7, 8) defining a frame plane, and a sash (3) having a top member (9), a bottom member (10) and two side members (11, 12) defining a sash plane, the sash (3) carrying a pane (4), the window (1) further comprising in connection with said bottom sash member (10) a bottom sash covering (319), wherein the roof window (1) furthermore comprises an insulating element (303) and preferably also a bottom sash gasket 310 adapted for insulating of the transition between the bottom sash member (10) and the bottom sash covering (319).

10 Claims, 9 Drawing Sheets

(56) References Cited

U.S. PATENT DOCUMENTS

Figure 2:
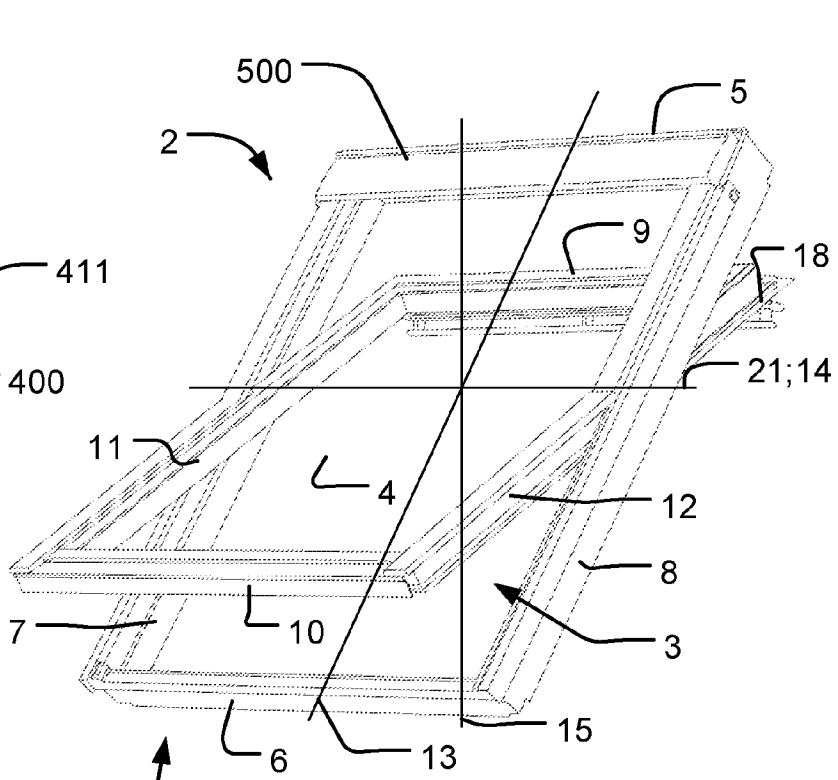

| | | | | | |
|---|---|---|---|---|---|
| 5,044,133 | A * | 9/1991 | Sampson et al. | 52/72 |
| 5,103,603 | A * | 4/1992 | Verby et al. | 52/72 |
| 5,207,036 | A * | 5/1993 | Sampson et al. | 52/72 |
| 5,355,644 | A * | 10/1994 | Guhl et al. | 52/200 |
| 5,664,384 | A * | 9/1997 | Cullinan | 52/507 |
| 5,669,186 | A * | 9/1997 | Verby et al. | 52/72 |
| 5,913,785 | A * | 6/1999 | M.o slashed.ller et al. | 52/200 |
| 6,640,508 | B2 * | 11/2003 | Lindgren et al. | 52/200 |
| 6,647,676 | B1 * | 11/2003 | Hansen et al. | 52/200 |
| 6,904,725 | B1 * | 6/2005 | Hansen et al. | 52/200 |
| 8,191,317 | B2 * | 6/2012 | Lundsgaard et al. | 52/72 |
| 8,448,393 | B2 * | 5/2013 | Voegele et al. | 52/200 |
| 2012/0240491 | A1 * | 9/2012 | Voegele et al. | 52/200 |

* cited by examiner

ROOF WINDOW WITH AN INSULATING ELEMENT

The present invention relates to a roof window comprising a frame with a top member, a bottom member and two side members defining a frame plane, and a sash having a top member, a bottom member and two side members defining a sash plane, the sash carrying a pane.

Roof windows of this kind are known in a number of different configurations and have proven to function very well in a number of different uses. In roof windows developed with the purpose of meeting newer and ever stricter requirements regarding energy conservation, i.e. the so-called U-value, however, the above-mentioned known types of window constructions have turned out to have inadequate energy conservation properties.

It is therefore an object of the present invention to provide a roof window, which with improved insulating properties.

This is achieved with a roof window of the above kind comprising an insulating element at the transition between the bottom sash member and the bottom sash covering, preferably spanning the gap between the bottom members of the sash and the frame in the closed state of the window.

Thereby a window is achieved with which previously present thermal bridges in the bottom sash structure of the window, particularly between the bottom sash member and the sash covering above glass, may be avoided, thus ensuring a window having improved energy conservation properties and thereby an improved U-value.

In a preferred embodiment, the roof window further comprises at least one, preferably at least two, pane holding devices, and the insulating element comprises at least one, preferably at least two, recesses shaped such as to be adapted to accommodate a pane holding device. The pane holding devices preferably fits closely in the recesses thereby avoiding the creation of air spaces between the insulating element and the pane holding device(s) and thus providing even better insulating properties.

A further improvement of the insulating properties of the insulating element, and thereby of the energy conservation properties of the roof window, may be achieved by using an insulating element with a first surface having a contour substantially corresponding to the contours of a surface of a bottom sash covering facing the bottom sash member in the mounted position.

In a particularly preferred embodiment for a roof window which furthermore comprises a bottom sash gasket. The insulating element may then comprise a second surface having a profiling, preferably such as slots or recesses, adapted for engagement with corresponding profiling, such as ribs or protrusions, on the bottom sash gasket, thus providing a close fit with the bottom sash gasket for better insulation. In the close state of the window the bottom sash gasket preferably spans the gap between the bottom members of the sash and the frame so as to improve insulating.

Further preferred embodiments and advantages will be apparent from the following detailed description and the appended dependent claims.

Figure 1:
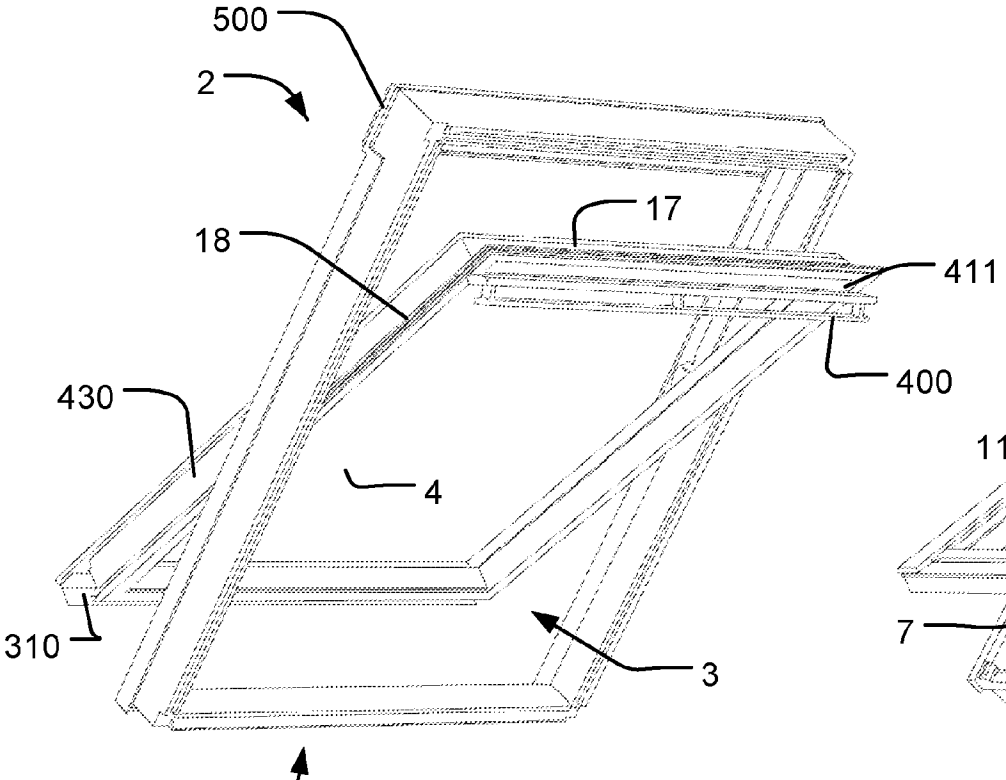
Figure 3:
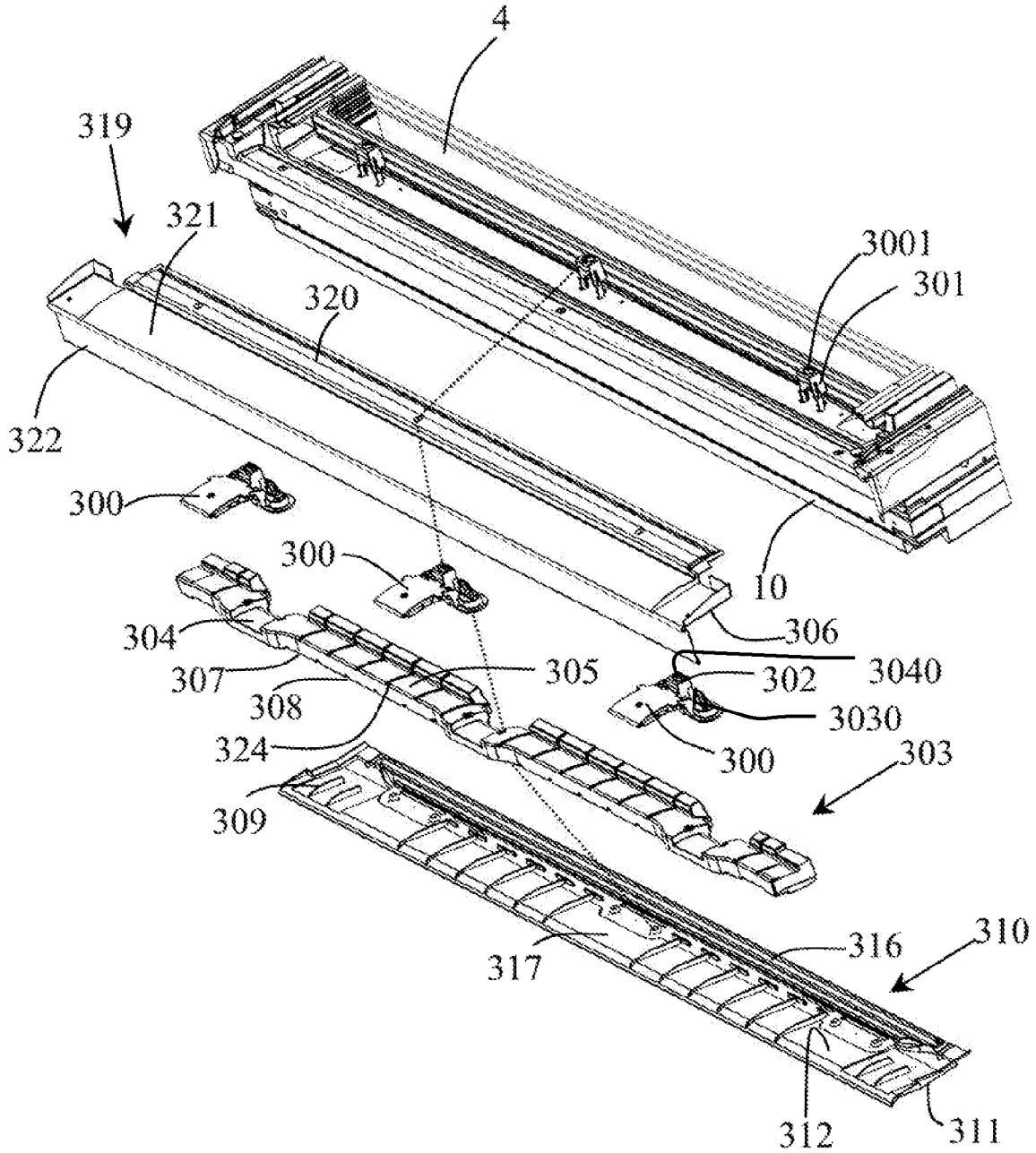
Figure 4:
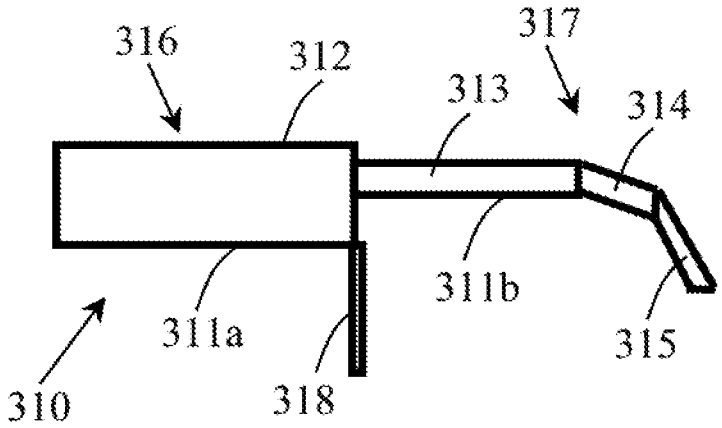
Figure 5:
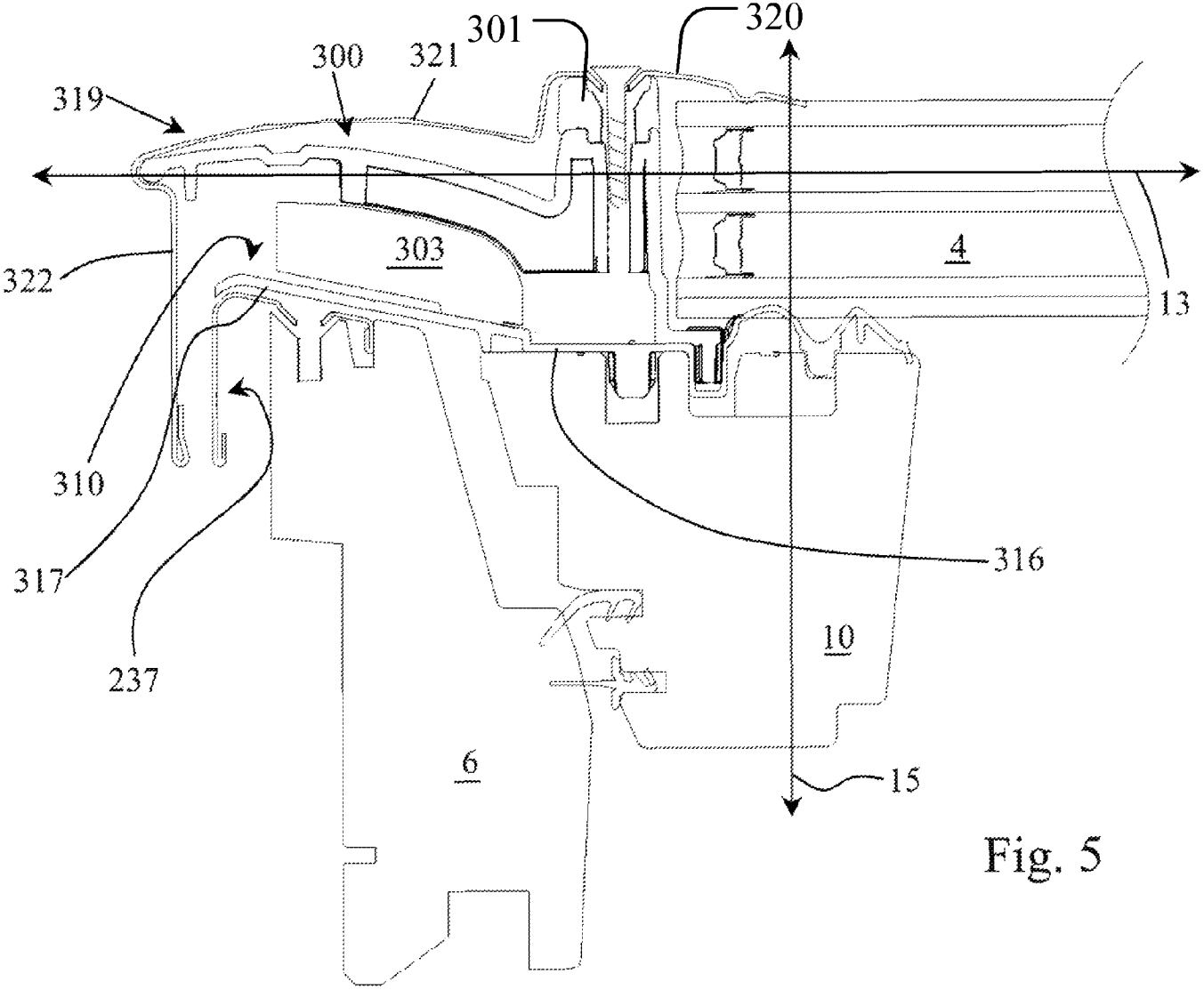
Figure 6:
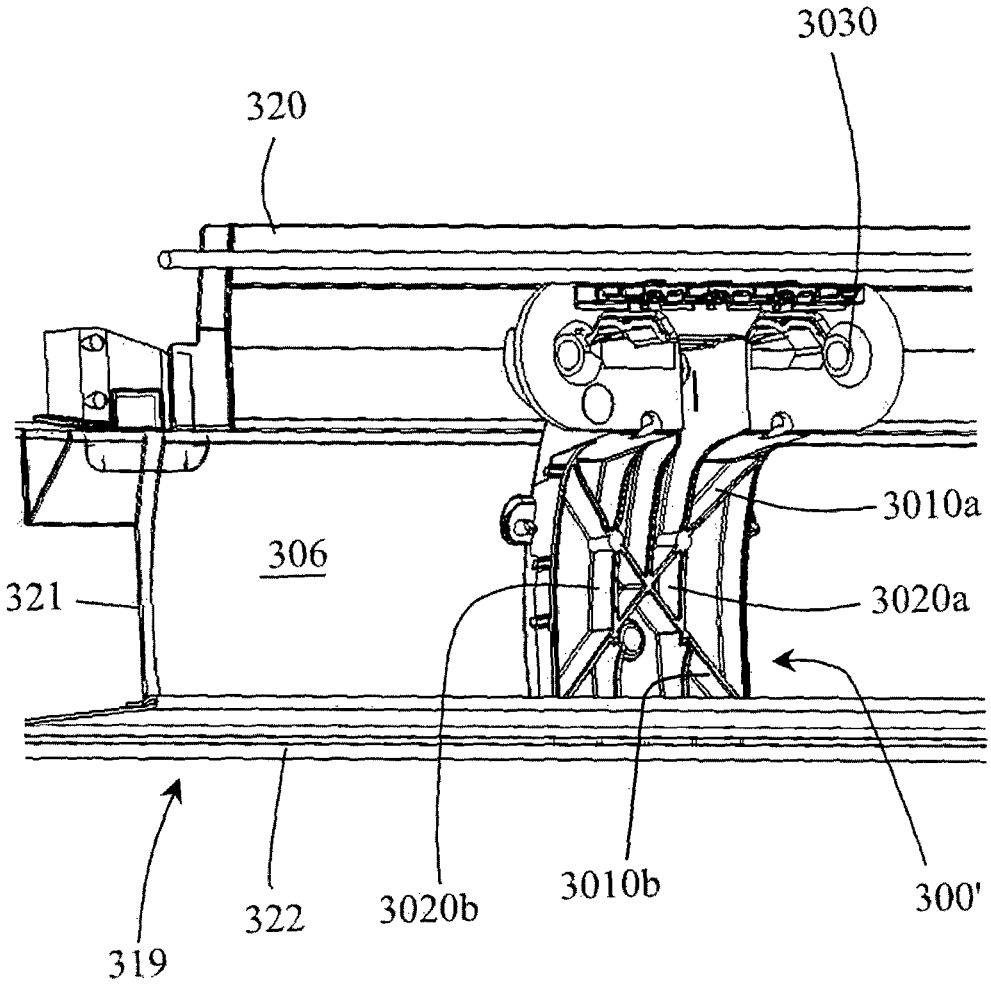
Figure 7:
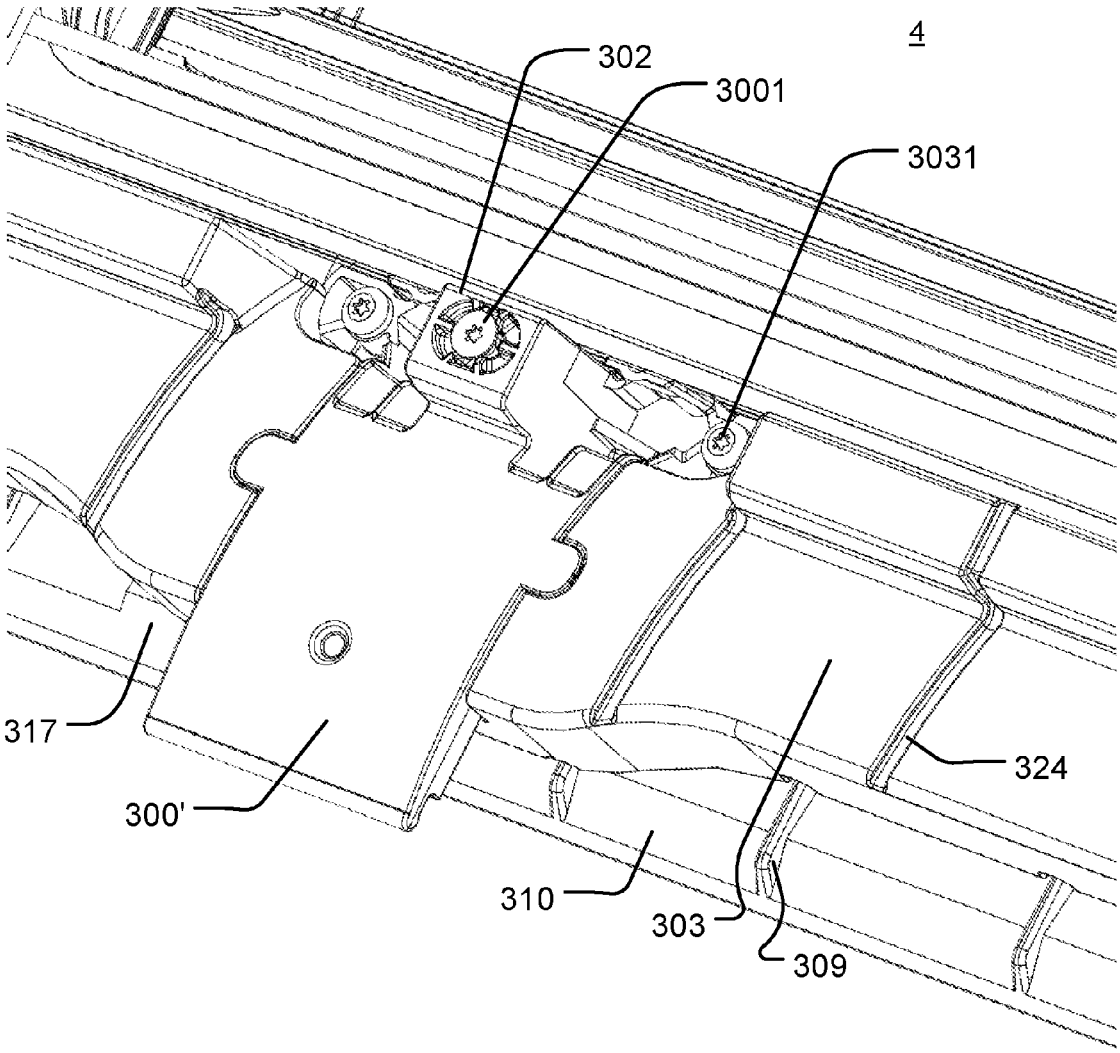
Figure 8:
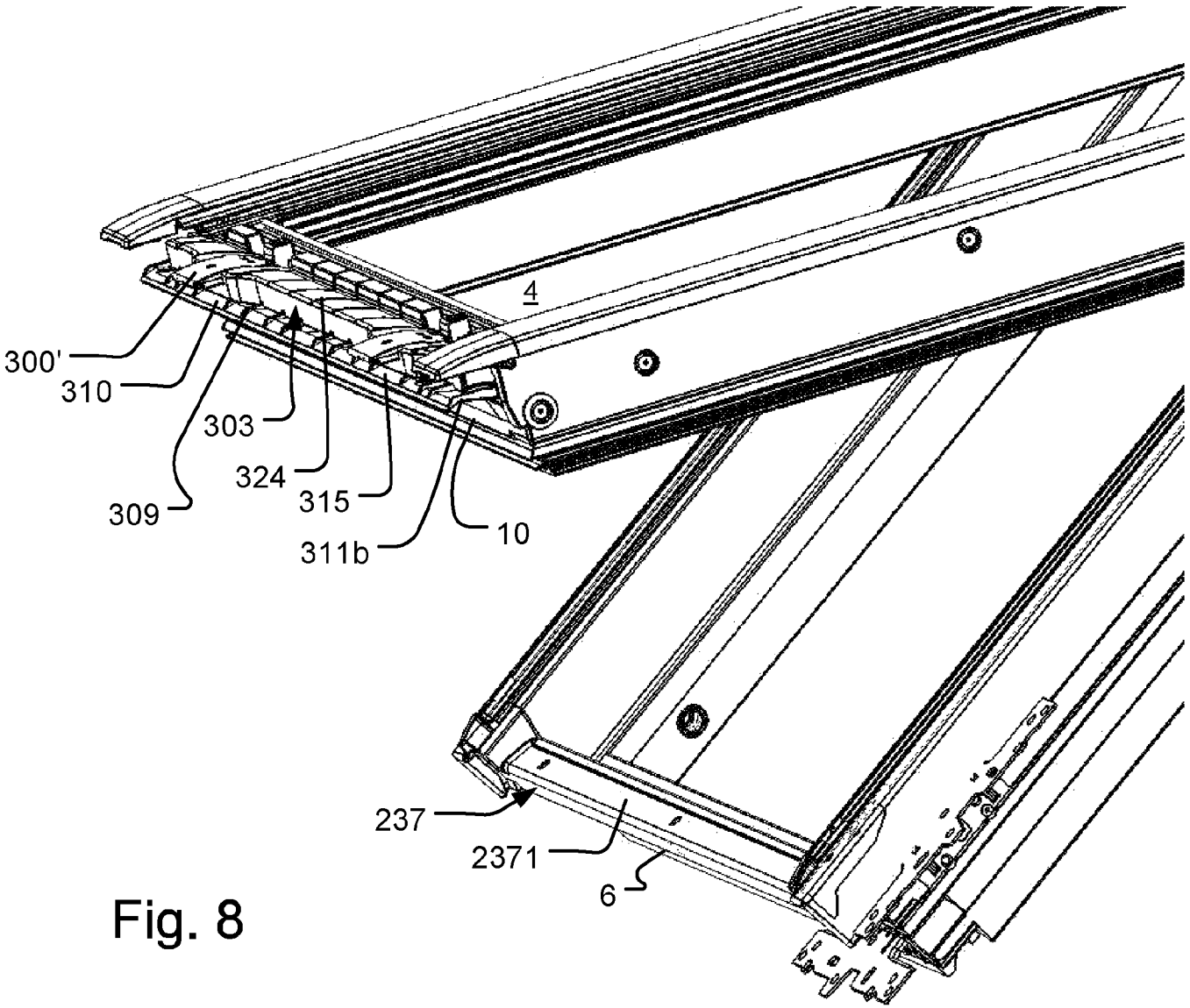

The invention will be explained in more detail below by means of a non-limiting example of an embodiment and with reference to the schematic drawing, in which FIG. 1 shows a perspective view of a window according to the invention in the assembled state seen from the interior, FIG. 2 shows a perspective view of a window according to the invention in the assembled state seen from the exterior, FIG. 3 shows an exploded view of a bottom sash member of a window according to the invention featuring an insulating element according to the invention, FIG. 4 shows a cross sectional view of a bottom sash gasket as shown in FIG. 3, FIG. 5 shows a cross sectional view through a bottom part of a roof window according to an embodiment of the invention, FIG. 6 shows a perspective view of a bottom sash covering and a pane holding device according to the invention seen from below, FIG. 7 shows a pane holding device as in FIG. 6 but seen from above in the mounted state with the bottom sash covering removed, FIG. 8 shows the lowermost parts of the sash and frame of an open roof window according to the invention, FIGS. 9 and 10 correspond to FIGS. 1 and 2 showing a roof window according to the invention in two different positions.

FIG. 1 and FIG. 2 show a preferred embodiment of a window 1 according to the invention comprising a pane 4 defining plane 16, a frame 2 having a top member 5, a bottom member 6 and two side members 7, 8 defining a frame plane, and a sash 3 having a top member 9, a bottom member 10 and two side members 11, 12 defining a sash plane. In the embodiment shown, the window is centre-hung in that the sash 3 is connected to the frame 2 by a pivot hinge (not shown) provided between side members 7, 11; 8, 12 of the frame 2 and sash 3, respectively, to be openable by tilting the sash 3 of the window 1 about the pivot hinge axis 21 defined by the pivot hinge. The pivot hinge comprises two parts, namely a sash part and a frame part.

The hinges used are preferably of the type described in the applicant's earlier patent applications WO9928581 and GB1028251, where a curved member and a tap on one hinge part travels in a curved guide track in the other during opening and closing of the window. The radius of curvature entails that when using such hinges, the hinge axis lies at a small distance above the actual hinge parts and as the sash frame is turned first the curved member and then the tap comes out of the track. In combination this provides a pattern of movement which allows easy operation of a centre-hung window and allows the sash frame to be turned substantially entirely around.

As used in this description, a closed position of the window 1 means a position in which the frame plane and the sash plane coincide, that is form an angle of 0 degrees with each other. Similarly an open position of the window 1 as used herein generally means a position in which the sash 3 is tilted about the pivot hinge axis 21 such that the frame plane and the sash plane no longer coincide.

As seen in FIG. 1 a longitudinal axis 13 of the window 1 is defined as extending perpendicular to and between the frame top member 5 and the frame bottom member 6, a transversal axis 14 of the window is defined as extending perpendicular to and between the respective frame side members 7 and 8 and thereby perpendicular to the longitudinal axis 13 and a depth axis 15 of the window 1 is defined as extending perpendicular to both the longitudinal axis 13 and the transversal axis 14. The pivot hinge axis 21 and the transversal axis 14 are parallel, and are shown as coinciding in the figures. The window 1 furthermore comprises a locking assembly 17 of a type known per se for locking the frame 2 and sash 3 to each other as well as a generally circumferentially extending sealing 18 provided on the sash 3 for sealing the gap between the sash 3 and the frame 2 in the closed position of the window 1. The sealing 18 comprises at least one, preferably at least two sealing strips.

Notwithstanding the centre-hung window 1 shown in FIG. 1 the window according to the invention may in other embodiments be top-hung, with or without an intermediate frame structure, have the hinge axis somewhere between the top and the centre, be side-hung or for that matter even be bottom-hung.

The sash 3 and frame 2 of the window according to the invention may for example be made of wooden members or members made of cast or extruded polyurethane (PUR).

With reference to FIGS. 3, 5, 6, 7 and 8, the window 1 comprises, at the bottom sash member 10 of the sash 3, three pane holding devices 300, 300' for holding the pane 4 such as to keep it from falling out of the sash 3 of the window. Depending on the size of the window it may be sufficient with one or two pane holding devices or more than three may be needed. The number needed may also depend on the shape, strength and mode of attachment of the pane holding devices.

Each pane holding device 300, 300' is shaped in such a way that it has a face 302 adapted for abutment with the pane 4. The pane holding device 300, 300' may for instance be substantially box shaped or substantially wedge-shaped as in the drawing, depending on the space available underneath the bottom sash covering 319, which is at least partly determined by the desired external shape of the window. The pane holding device may possibly be arranged with substantially its entire exterior surface abutting the bottom sash covering, which will provide a good support for the bottom sash covering, but to optimise the insulating properties an air gap in preferably provided between them.

As exemplified in FIG. 6 the pane holding device 300, 300' may be provided with a rib structure adapted for providing the pane holding device with increased structural strength. Thereby an improved support for both the pane and the bottom sash covering 319 is provided. The rib structure comprises a pair of longitudinal and substantial parallel ribs 3020*a* and 3020*b* as well as a pair of substantially diagonal ribs 3010*a* and 3010*b*. The rib structure may however in principle comprise any feasible number of ribs and it may have any feasible structure suitable for providing additional strength. For instance the rib structure may comprise just the pair of diagonal ribs or it may comprise more or fewer than two substantially parallel ribs. Preferably the rib structure and the pane holding device 300 are moulded in one piece, but it is also possible to use a separate strengthening member.

The pane holding devices 300 are adapted for providing a reliable and durable attachment of the bottom sash covering 319. They thus not only have a shape, which allows them to be located underneath the covering, but are also design for supporting the covering and preventing deformation thereof, e.g. when the covering is affected by heavy wind or snow. Particularly the points where mounting screws penetrate the bottom sash covering may need to be supported by the pane holding devices. The layout of the ribs described above may be at least partially defined by such considerations.

In the embodiment in FIGS. 6-8, the bottom sash covering 319 is attached directly to the pane holding device 300, using a screw 3001 penetrating into the material of the pane holding device. Alternatively or as a supplement, it is possible to use holding clips 301 as shown in FIGS. 3 and 5. These holding clips then functions as a guide for the screw and as a distance keeper creating a space between the bottom sash covering 319 and the pane holding device 300.

The holding clips 301 may, however, also serve for establishing a connection between the bottom sash covering 319 and pane holding device by being adapted for a snap locking engagement with the pane holding device 300. The screw is then only needed for attaching the holding clip to the bottom sash covering. This may ease the mounting of the covering, prevent the formation of a thermal bridge and allows easy detachment of the bottom sash covering for maintenance, repair or replacement. Such holding clips may be embodied as described in the applications co-pending application filed on the same day and titled "A roof window with a covering fastening device".

The pane holding device 300 may be provided with an aperture 3040 adapted for engagement, preferably in a snap-locking manner, with such a holding clip 301, cf. FIG. 3.

The pane holding devices 300, 300' and holding clips 301 are preferably made of a hard plastic and the pane holding device 300 is preferably provided with holes 3030 for accommodating screws 3031 for attachment to the window structure as shown in FIG. 6-8.

The bottom sash covering 319 here comprises a first section 320, a second section 321 and a third section 322. The first section 320 is adapted for abutment with the pane 4. The second section 321 extends substantially in extension of and in parallel with the first section 320 and is adapted for covering the underlying pane holding device(s) 300, 300', insulating element 303, bottom sash gasket 310 and bottom sash member 10. The third section 322 extends from and substantially perpendicular to the second section 321 and is adapted for shielding a surface of the bottom sash member 10 facing away from the pane 4 in the longitudinal direction 13 of the window 1.

An insulating element 303 is provided for insulation of the transition between the bottom sash member 10 and the bottom sash covering 319. The insulating element 303 comprises at least one, preferably at least two, recesses 304 each shaped to accommodate a pane holding device 300, 300'. The recess 304 is preferably shaped such as to provide a close fit around the pane holding device 300, thereby providing optimum insulation conditions in the vicinity of the pane holding device 300. If using a soft material for the insulating element 303, the recess might also be formed by simply pressing the holding device 300, 300' into the insulating element, thereby compressing the insulating material. This is, however, less preferred as it will influence the insulating properties negatively.

The insulating element 303 is preferably made of styrene, polystyrene, expanded polystyrene (EPS) or extruded polystyrene (XPS). The insulating element 303 is preferably made as one element, but may in principle also be several elements arranged adjacent to each other. The insulating element 303 is attached to the bottom sash member 10 with a fastener or bonder (not shown), such as e.g. screws, glue or an adhesive, in such a way as to be placed between the bottom sash member 10 and the bottom sash covering 319. Preferably the insulating element 303 and the pane holding device(s) 300 are attached using the same fastener, preferably a screw, extending through both elements and into the bottom sash member 10 prior to attaching the pane 4 and the bottom sash covering 319 to the window 1.

The insulating element 303 is preferably provided with a first surface 305 having a contour substantially corresponding to the contours of the surface 306 of the bottom sash covering 319 facing the bottom sash member 10 in the mounted position.

The insulating element 303 furthermore extends from the bottom sash member 10 in a direction away from the pane 4 of the window 1 in the longitudinal direction 13 of the window 1. The insulating element 303 is provided with a second surface 307, which may have profiling 308, preferably such as slots or recesses, adapted for engagement with corresponding profiling 309, such as ribs or protrusions, of a bottom sash gasket 310, which will be described in the following.

In the first surface 305 of the insulating member, grooves 324 are provided extending in the longitudinal direction 13 of the window. These grooves are intended to serve as drainage grooves to drain of any moisture accumulating underneath the bottom sash covering 319, e.g. as a result of condensation.

The provision of an insulating element 303 as described above is particularly preferred in the case of a window 1 having a wooden frame 2 and sash 3. In case of a window having a frame 2 and sash 3 made of polyurethane or the like the insulating element and the bottom sash member 10 may be one integral element.

Still referring to FIGS. 3, 5, 6, 7 and 8, the window 1 furthermore comprises a bottom sash gasket 310 attached to the bottom sash member 10, and preferably made of a rubber material. The bottom sash gasket 310 is intended for sealing the gap between the bottom sash member 10 and the bottom frame member 6 in the closed position of the window 1.

Referring also to FIG. 4, the bottom sash gasket 310 comprises first part 316, a second part 317, a first surface 311 comprising a first surface part 311 a corresponding to the first part 316 and a second surface part 311*b* corresponding to the second part 317, and a second surface 312 opposite the first surface 311. The first part 316 is adapted for attachment with the bottom sash member 10 and the second part 317 is extending from the bottom sash member 10 in a direction substantially away from the pane 4 in the longitudinal direction 13 of the window 1 when attached to the bottom sash member 10. As is best seen in FIG. 5, the bottom sash gasket 310 thus projects over the lower end of the sash and spanning the gap between the sash bottom member 10 and frame bottom member 6. The insulating element 303 also projects over this gap, but does not extend as far as the gasket.

In the embodiment shown in FIG. 5, the bottom sash gasket 310 extends over the entire width of the bottom sash member 10 and thus also contributes to water-proofing the joint between the pane 4 and the sash 3, but it is to be understood that this need not be the case and/or that the gasket may be fixated solely by being clamped between the insulating element 303 and the bottom sash member 10.

The bottom sash gasket 310 may comprise a profiling 309, such as ribs or protrusions, for engagement with a corresponding profiling 308, such as slots or recesses, in a surface 307 of the insulating element 303 described above. Preferably, the second surface 312 comprises the profiling 309.

The first surface part 311*a* of the first surface 311 is adapted for being attached to the bottom sash member 10. The second surface part 311*b* of the first surface 311 is adapted for close abutment against a bottom frame covering 237, which is mounted on the bottom frame element 6, in the closed position of the window 1 such as to seal the gap between the bottom sash member 10 and the bottom frame member 6 in the closed position of the window 1 as is best seen in FIGS. 5 and 8. To this end the second part 317 of the bottom sash gasket 310 is configured as described in the following.

As shown in cross section on FIG. 4, the first part 316 of the bottom sash gasket 310 is substantially plane and rectangular in cross section, whereas the second part 317 comprises a first cross sectional section 313, a second cross sectional section 314 and a third cross sectional section 315. The first cross sectional section 313 extends substantially in parallel with and in extension of the first part 316. The second cross sectional section 314 is angled, preferably 10 to 45 degrees, with respect to the first cross sectional section 313, and the third cross sectional section 315 is angled, preferably 45 to 85 degrees, with respect to the second cross sectional section 314 such that the second part 317 comprises a substantially hook shaped cross section.

The second part 317 may, in addition to the above, be adapted for sealing abutment with the third section 322 of the bottom sash covering 319. In this connection, the hook shaped cross sectional configuration of the second part 317 has the further advantage of providing a larger abutment surface and thus better sealing properties.

The bottom sash gasket 310 may further comprise at least one flange 318 provided extending substantially in a right angle from the first surface 311, preferably at the transition between the first part 316 and the second part 317. The flange 318 is adapted for abutting the surface of the bottom sash member 10 facing away from the pane 4 in the longitudinal direction 13 of the window 1, such as to ensure that no moisture may penetrate between the bottom sash gasket 310 and the bottom sash member 10.

When closing the window the outmost section 315 and possibly also the second section 314 of the gasket 310 comes into contact with the upper exterior surface 2371 of the bottom frame covering 237 as may be seen from FIGS. 5 and 8 in combination.

The bottom sash covering 319, pane holding device(s) 300, 300', insulating element 303 and bottom sash gasket 310 may all be attached to the bottom sash member 10, preferably in the order mentioned, by the same fastener, preferably at least one screw, extending through all of the elements 319, 300, 303 and 310 and into the bottom sash member 10. A separation in two or more attachment steps may, however, prevent the formation of a thermal bridge and may therefore also be advantageous.

The above described embodiment of the insulating element 303 and the bottom sash gasket 310 is particularly intended for windows 1 having a sash 3 and a frame 2 made of wood.

In case of windows 1 having a sash 3 and a frame 2 made of extruded or cast polyurethane (PUR) or similar materials, the bottom sash member 10 and the insulating element 303 may be made as one integral element, whereas the bottom sash gasket 310 may be provided as one or more sealing strips or similar suitable elements arranged in a groove or recess in the integral bottom sash member 10 and insulating element 303.

Figure 9:
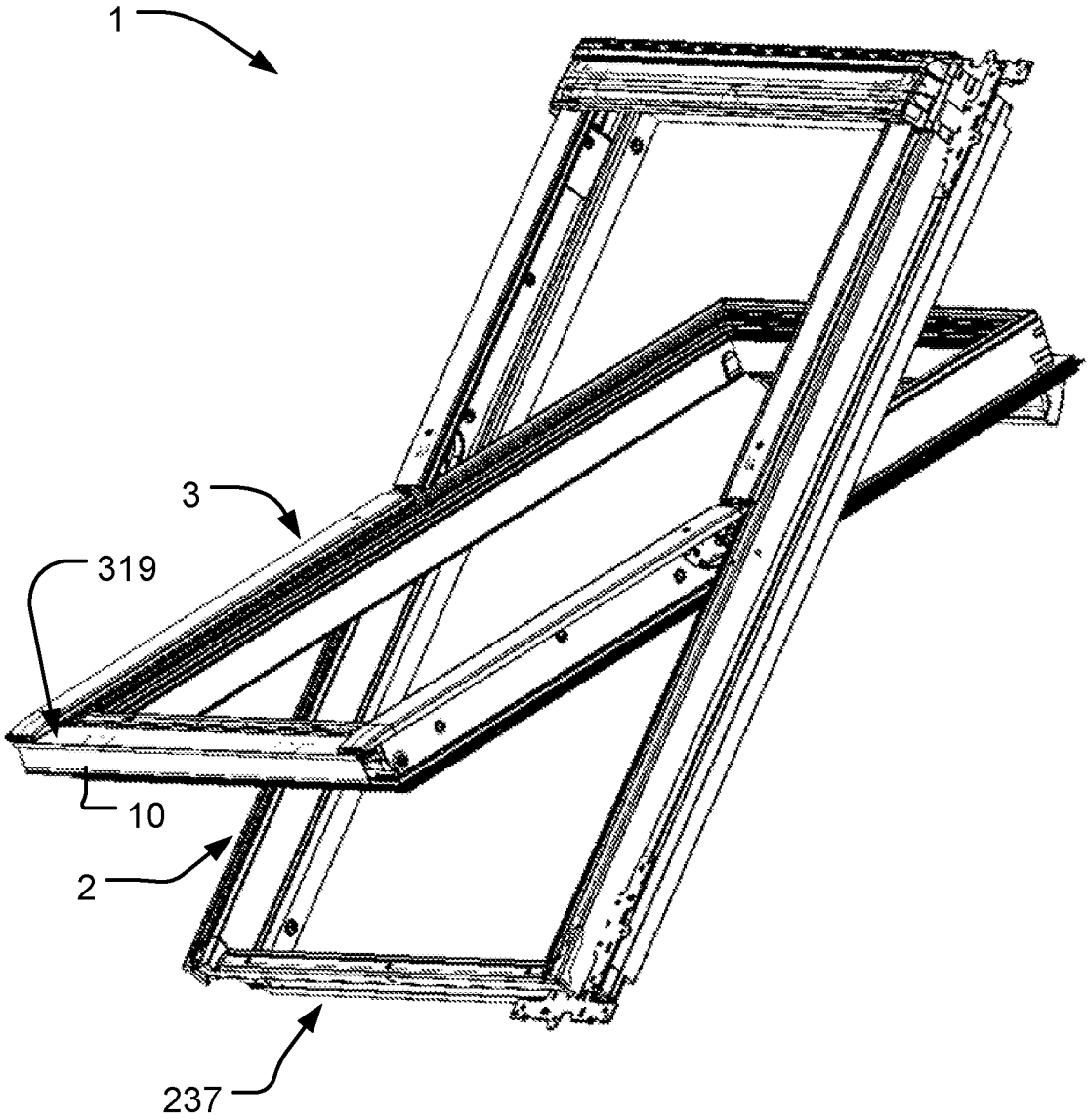
Figure 10:
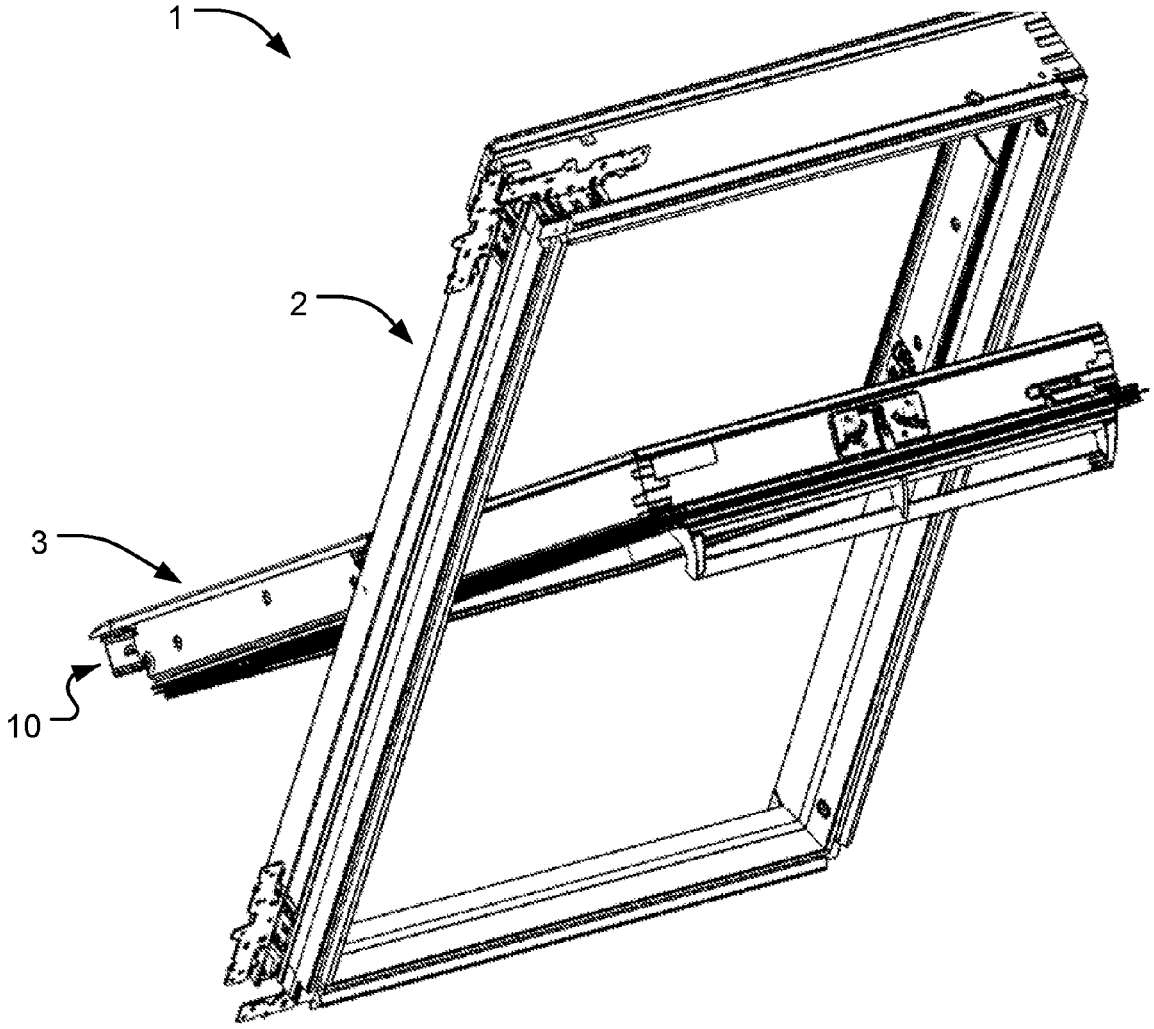

A window according to the invention is shown in an open state from two different angles in FIGS. 9 and 10.

It should be noted that the above description of preferred embodiments serves only as an example, and that a person skilled in the art will know that numerous variations are possible without deviating from the scope of the claims.

The invention claimed is:

1. A roof window, comprising:

a frame, the frame having a top frame member, a bottom frame member, and two side frame members that define a frame plane, a sash having a top sash member, a bottom sash member and two side sash members defining a sash plane,the sash carrying a pane, wherein the roof window defines a pivot hinge axis and the sash is tiltable relative to the frame about the pivot hinge axis, thereby allowing the roof window to be opened, the bottom frame member and the bottom sash member both being parallel to the pivot hinge axis, a bottom sash covering in connection with the bottom sash member, an insulating element and a bottom sash gasket, both disposed between the bottom sash member and the bottom sash covering, the roof window having a closed state in which the insulating element spans between the bottom sash member and the bottom frame member; and a pane holding device, wherein the insulating element defines a recess and the pane holding device is disposed in the recess.

2. The roof window of claim 1, wherein the recess is shaped such as to provide a chase fit around the pane holding device.

3. The roof window of claim 1, wherein the bottom sash covering defines a first contour and wherein the insulating element defines a second contour, the first contour substantially corresponding to the second contour.

4. The roof window of claim 1, wherein the bottom sash gasket includes a first profiling and the insulating element includes a second surface having a second profiling, the first and second profiling configured for engagement with each other.

5. The roof window of claim 4, the roof window having a closed state in which the bottom sash gasket spans between the bottom members of the sash and the frame.

6. The roof window of claim 1, wherein the insulating element is made of material selected from the group consisting of styrene, polystyrene, expanded polystyrene, and extruded polystyrene.

7. The roof window of claim 1, wherein the insulating element is made as a single element.

8. The roof window of claim 1, wherein the insulating element is made as several mutually connected elements.

9. The roof window of claim 1, wherein the insulating element and the bottom sash member are connected by screws, glue, or an adhesive.

10. The roof window of claim 1, wherein the insulating element and the bottom sash member are provided as a single integral element.

* * * * *